US006550398B1

(12) United States Patent
Clark et al.

(10) Patent No.: US 6,550,398 B1
(45) Date of Patent: Apr. 22, 2003

(54) CHAFING REDUCTION DEVICE FOR A CENTER BEAM RAILWAY CAR

(75) Inventors: James Stephen Clark, St. John, IN (US); Charles L. Van Auken, Dillsburg, PA (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/001,930

(22) Filed: Oct. 31, 2001

(51) Int. Cl.[7] ..... B61D 17/00
(52) U.S. Cl. ..... 105/404; 105/355
(58) Field of Search ..... 105/355, 404, 105/406.1, 411, 416; 410/100

(56) References Cited

U.S. PATENT DOCUMENTS 3,159,112 A * 12/1964 Tomlinson ..... 105/367
3,244,120 A * 4/1966 Tayor ..... 105/414
3,734,031 A * 5/1973 Wagner ..... 105/404
4,543,887 A * 10/1985 Baker ..... 105/355
4,753,175 A * 6/1988 Harris et al. ..... 105/355
4,784,067 A * 11/1988 Harris et al. ..... 105/355
4,802,420 A * 2/1989 Butcher et al. ..... 105/355
4,951,575 A * 8/1990 Dominguez et al. ..... 105/406.1
5,024,567 A * 6/1991 Dominguez et al. ..... 410/100
5,626,083 A * 5/1997 Saxton ..... 105/355
5,899,646 A * 5/1999 Tatina et al. ..... 410/100

* cited by examiner

*Primary Examiner*—S. Joseph Morano
*Assistant Examiner*—Lars A. Olson
(74) *Attorney, Agent, or Firm*—Fitch, Even, Tabin & Flannery

(57) ABSTRACT

The invention is directed to a center beam railway car adapted for reducing chafing between lading and a center beam structure of the railway car. According to an embodiment of the invention, lading may be stacked against rollers provided along the center beam structure to reduce friction between the center beam structure and the lading. In an embodiment of the invention, the rollers may be adapted to accommodate both horizontal and vertical relative movement between the lading and the center beam structure of the railway car.

24 Claims, 3 Drawing Sheets

CHAFING REDUCTION DEVICE FOR A CENTER BEAM RAILWAY CAR

FIELD OF THE INVENTION

The invention relates generally to a center beam railway car, and particularly to a center beam railway car adapted for reducing chafing of lading.

BACKGROUND OF THE INVENTION

Center beam railway cars typically comprise a floor surface supported by a pair of trucks, a bulkhead disposed proximate each end of the car, and a longitudinally extending vertical center beam structure. Lading is usually placed on the floor surface along both sides of the center beam structure. If the lading is in bundles, multiple bundles are typically stacked up to the height of the center beam structure. The lading is usually stacked against the center beam structure to provide lateral support therefor. An example of a center beam railway car is disclosed in U.S. patent application Ser. No. 09/635,978, filed Aug. 9, 2000.

To help secure the lading relative to the railway car, straps or cables may extend over the lading. The straps or cables exert most of their forces on the uppermost bundles of lading, urging the uppermost bundles both downward and inward against the center beam structure.

In the transportation of lading on center beam railway cars, chafing can occur between the bundles of lading and the railway car. In particular, it has been found that the top 12" to 18" of the uppermost bundles are subject to considerable chafing. Chafing may result in undesirable damage to the lading. For example, if the lading comprises bundles of lumber wrapped in plastic sheeting, the innermost piece or pieces of lumber on the uppermost bundle may rub against the center beam structure and become damaged. Furthermore, the plastic sheeting may tear due to the chafing or rubbing, allowing moisture into the wrapped bundle of lumber. The lumber may become marred with mildew or mold if moisture enters the bundle through a torn plastic wrapping. Damage to the lading caused by chafing contact with the center beam structure may be even more substantial on trips of greater length.

Chafing between the lading and the center beam structure may not only damage the lading, but also the center structure. The center beam structure, like the majority of the railway car, is usually painted to help protect the railway car from rusting. When the bundles of lading rub against the painted center beam structure, the paint may rub off or become worn away, exposing the steel underneath to rusting. Furthermore, a rusty center beam structure may cause undesirable rust staining of any exposed lumber rubbing thereagainst.

The chafing may be largely due to movement of the lading relative to the center beam structure of the railway car. This movement may be both vertical and horizontal. The relative movement may be due to either or both shifting of the lading and flexure of the center beam structure. The movement of the center beam structure relative to the remainder of the car can be particularly acute near the top of the structure, and near the longitudinal midpoint of the structure.

Numerous attempts have been made to reduce chafing between the lading and the center beam structure of a center beam railway car. For example, center beam cars having lowered center beam structures have been made to attempt to reduce chafing of the lading. The uppermost bundles of lading can be stacked above the shortened center beam structure and against each other to eliminate contact of the uppermost bundles with the structure. However, it has been found that chafing may still result from contact between adjacent, uppermost bundles of lading during transportation.

It has also been suggested that chafing may be reduced by reinforcing center beam structures to reduce movement of the structure relative to the remainder of the railway car during transportation. While reinforced center beam structures may reduce movement of the structure, they add significantly to the weight of the railcars and may reduce the total weight of lading that can be transported. Furthermore, unless all relative movement between the lading and the center structure is eliminated, chafing may still occur.

Other suggestions have included placing stationary or movable plastic pads between the lading and the center beam structure. One test was performed by attaching plastic pads formed of ultrahigh molecular weight (UHMW) polypropylene along a center beam structure of a center beam railway car. Lading was then placed along the center structure and the car was subjected to 10,000 cycles of 2500 pounds of force to simulate loads that may be experienced by the lading during a typical trip. Not withstanding the pads, the uppermost bundles were still severely damaged by chafing against the center structure.

Accordingly, there remains a need for reducing the chafing and resulting damage of lading transported by center beam railway cars.

SUMMARY OF THE INVENTION

In accordance with the invention, a center beam railway car is provided that is adapted to reduce chafing between lading and a center beam structure. The railway car may include apparatus to significantly reduce or eliminate chafing of the lading due to both vertical and horizontal relative movement between the lading and the center beam structure.

In an embodiment of the invention, chafing between the center beam structure and the lading may be reduced by providing roller members between the center structure and the lading. The roller members may be adapted to reduce or eliminate friction between the lading and the center structure.

In an embodiment of the invention, the rollers may be mounted to the center beam structure such that friction is reduced due to both horizontal and vertical relative movement between the lading and the center structure. The roller may comprise a roller member rotatably mounted around a shaft. The roller member may comprise a hollow cylinder having an outer surface for contacting the lading and an inner bore for receiving the shaft. Preferably the shaft has a diameter smaller than the inner bore of the roller member to provide sufficient clearance therebetween to allow the roller to freely rotate relative to the shaft. One or more bearings or bushings may be disposed between the shaft and the roller member to reduce friction therebetween. The bushing may comprise a non-metallic polymer sleeve for reducing maintenance. Opposing ends of the shaft may be fixed relative to the center beam structure.

The center beam structure may comprise a plurality of upstanding vertical post members having a top chord connecting their upper ends. Diagonal brace members may be arranged between adjacent or other select post members to further strengthen the structure.

The shafts of the rollers may be mounted between the vertical post members with brackets. The use of brackets may be desirable because minimal modifications to the center beam structure may be required, simplifying the retrofitting of existing center beam railway cars with the rollers of the invention. Horizontal lower brackets may be provided between adjacent post members for supporting the lower ends of the shafts. A hollow tube may extend upwardly from the lower bracket for receiving the lower end of the shaft to secure the shaft relative to the lower bracket. A horizontal upper bracket may be welded between downwardly extending legs of the top cord for supporting the upper end of the shaft. The upper bracket may include a hole for insertion of the upper end of the shaft.

In an embodiment of the invention, the roller member may have a recess at either its upper end, lower end, or both ends for receiving a spring. When the roller is mounted between the upper and lower brackets, each spring biases the roller member either downwardly or upwardly relative to the shaft, allowing the roller member to translate vertically to accommodate vertical movement of the lading relative to the center beam structure. In addition, the spring may assist in maintaining the roller securely mounted between the upper and lower brackets. For example, to insert the roller the upper end of the shaft may be pushed upward into the aperture formed in the upper bracket until the lower end of the shaft is able to clear the tube on the lower bracket for insertion therein. The spring will then bias the roller member into a preferred orientation relative to the lower bracket.

DETAILED DESCRIPTION OF THE DRAWINGS

Figure 1:
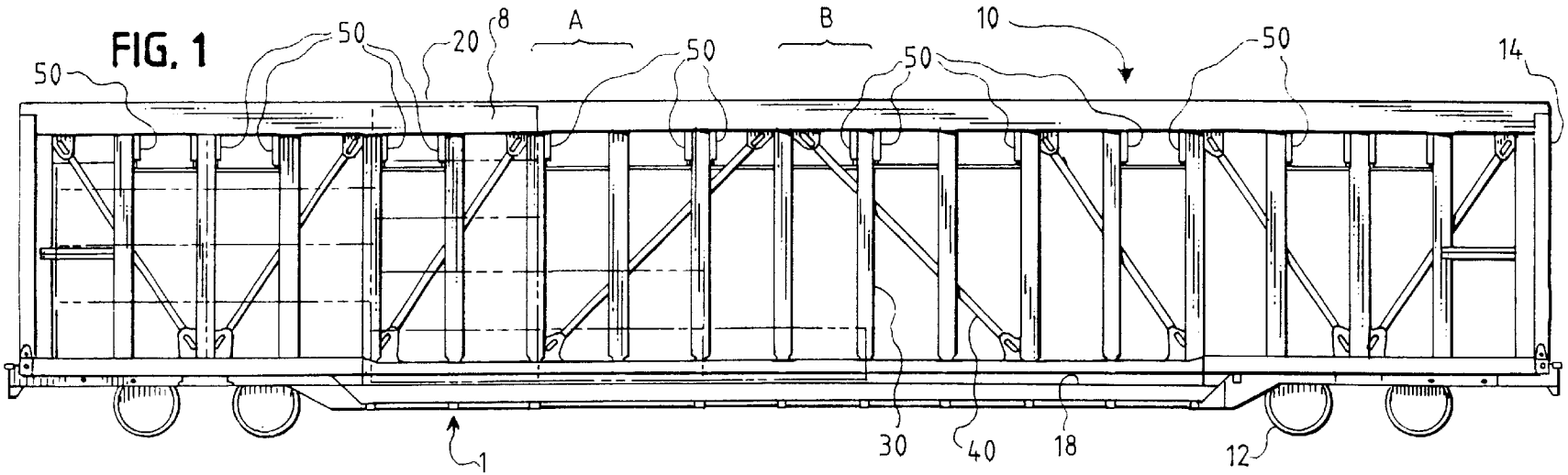
FIG. 1 is a side elevation view illustrating a center beam railway car in accordance with an embodiment of the invention.

The invention is preferably embodied in a center beam railway car 1 adapted for reducing chafing between lading 8 and a center beam structure 10. Preferred embodiments of the invention, wherein a roller 50 is positioned between at least some of the lading 8 and the center beam structure 10 to accommodate both horizontal and vertical relative movement therebetween, are discussed below.

FIGS. 1–7 illustrate a center beam railway car 1 adapted for reducing chafing in accordance with embodiments of the invention. The railway car 1 is provided with a plurality of rollers 50 between the center beam structure 10 and the lading 8 to reduce friction therebetween. At least some of the lading 8 transported on the railway car 1 has surfaces resting against generally vertically oriented rollers 50 instead of directly contacting the center beam structure 10. The rollers 50 are freely rotatable about their vertical axes to reduce chafing during horizontal relative movement between the lading 8 and the center beam structure 10. The rollers 50 are also adapted to generally vertically translate along their respective axes to reduce chafing during vertical relative movement between the lading 8 and the center beam structure 10.

The railway car 1 comprises a support surface for the lading 8 disposed on top of trucks 12 located at each end thereof. In the illustrated embodiment, the support surface includes an upper deck 17 proximate each end of the railway car 1. A lower deck 18 is disposed between the upper decks 17 to provide additional height capacity for carrying lading. End bolsters 14 are disposed proximate each end of the railway car 1 to provide support for and to retain the lading 8. A longitudinally extending center beam structure 10 is located along the center of the railway car 1 and between the end bolsters 14 to provide strength to the car 1.

The center beam structure 10 according to the illustrated embodiment of the invention comprises a plurality of upstanding vertical posts 30 extending upwardly along the longitudinal center of the railway car 1. Top portions of the vertical posts 30 are interconnected with a longitudinally extending top chord 20 to provide stiffness to the center beam structure 10 and thus the railway car 1. Diagonal brace members 40 extend between the vertical posts 30 to provide additional stiffness to the center beam structure 10.

In the illustrated embodiment, rollers 50 are mounted between some of the adjacent vertical posts 30. The rollers 50 are preferably longitudinally positioned along the center structure 10 so that each bundle of lading 8 contacts at least two rollers 50, regardless of the length of the bundles 8. For example, the rollers 50 may be positioned so that at least two contact each bundle 8 when the bundles are either 8', 10', 12', 14', or 16' in length. Arrangements of rollers 50 other than that illustrated in FIG. 1 may also be used. For example, one roller 50 may be positioned adjacent each vertical post 30, one roller 50 may be positioned adjacent each side of each vertical post 50, etc.

Figure 3:
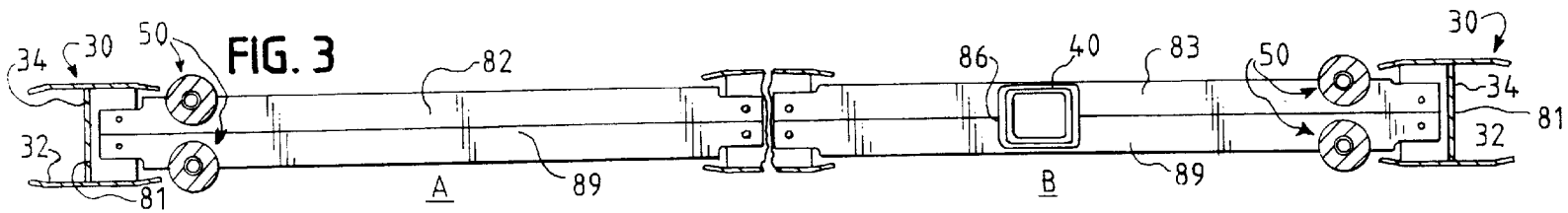
FIG. 3 is a sectional view of the center beam structure takes along line 3—3 of FIG. 2.
Figure 4:
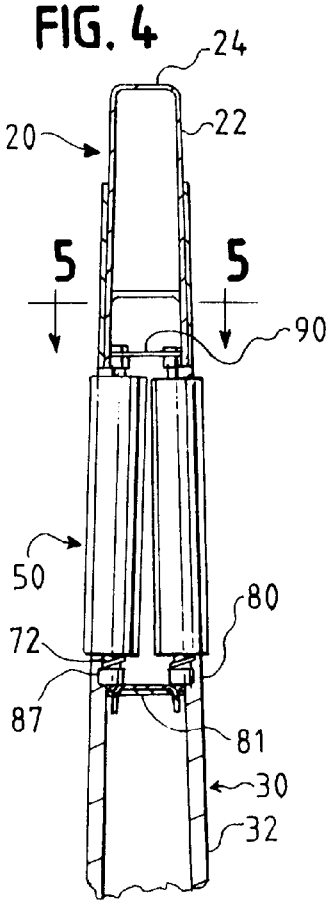
FIG. 4 is a sectional view of the center beam structure taken along line 4—4 of FIG. 2.
Figure 5:
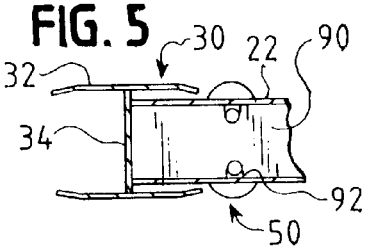
FIG. 5 is a sectional view of the center beam structure taken along line 5—5 of FIG. 4.
Figure 7:
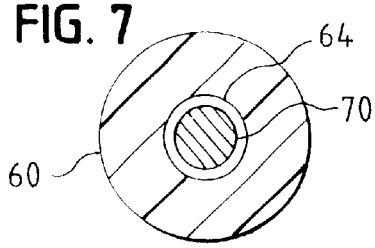
FIG. 7 is a sectional view of a roller of FIG. 6 taken along line 7—7.

The rollers 50 projects outwardly from a side of the center beam structure 10, as illustrated in FIGS. 3–5, so that lading 8 resting thereagainst mainly contacts the rollers 50. The rollers may entirely prevent the lading from contacting the vertical posts 30 and top chord 20, or may permit some contact, but reduce the contact and reduce friction therebetween to acceptable levels. The rollers 50 preferably are mounted near the top of the center beam structure 10 but below the top chord 20 such that at least the inner, top region of a bundle of lading 8 contacts the rollers 50 and has limited contact or no contact with the vertical posts 30 or other components of the center beam structure 10. However, rollers may also be positioned at least partially in cutouts formed in the top chord 20.

Figure 6:
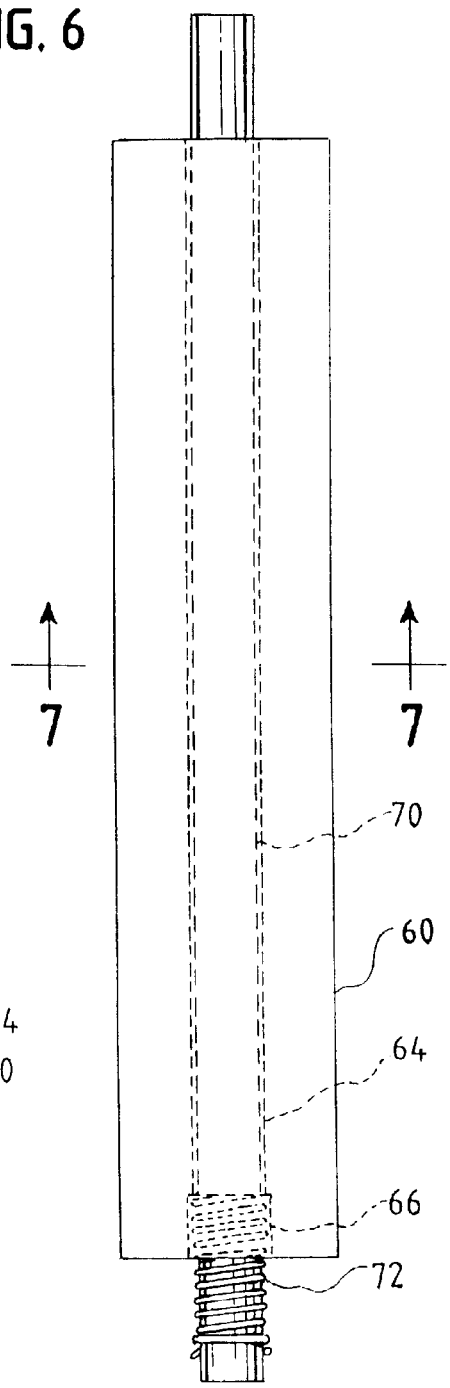
FIG. 6 is a side elevation view illustrating a roller of FIG. 2.

The rollers 50 each preferably comprise a hollow, cylindrical roller member 60 rotatably mounted around a shaft 70, as illustrated in FIG. 6. The roller member 60 has an outer surface for contacting the lading 8 and an inner bore 64 sized to permit clearance between the shaft 70 received therein. At the lower end of the roller member 60 a cylindrical recess or depression 66 is formed to receive a spring 72, as will be further described hereinbelow.

In a preferred embodiment of the invention, the roller member 60 is made of an ultrahigh molecular weight (UHMW) polymer, such as polypropylene. Other suitable polymers, steels, or other materials may also be used to form the roller member 60. The roller member 60 is preferably sized so that at least a portion of the uppermost bundle of lading 8 is in contact therewith, regardless of whether the lading 8 is part of a stack beginning on the upper or lower deck 17 or 18. In a preferred embodiment of the invention, the roller member 60 is between 12" and 24" in length, e.g., approximately 18" in length, and the outer diameter is between 3" and 4", e.g., approximately 3.5". The shaft 70 is preferably made of steel or other suitable materials. The shaft 70 in a preferred embodiment is 2" to 4" longer than the roller members, e.g., about 22" in length, and has a diameter of about 1". Shorter or longer rollers 50 may also be used, such as to extend between diagonal braces 40 and the top chord 20. The spring 72 is preferably made of steel and has a free length of approximately 3.5". The recess 66 has a depth of about 1" and a diameter sized to accommodate the diameter of the spring 72.

According to a preferred embodiment of the invention, the rollers 50 are mounted between upper and lower brackets 90 and 80, as illustrated in FIG. 5. Other bracket or mounted arrangements may also be used to position the rollers 50. In the embodiment illustrated in FIG. 1, pairs of rollers 50 are placed between select vertical posts 30 such that the outer surfaces of the roller members 60 project beyond the lateral surfaces of the vertical posts 30. In a preferred embodiment, the outer surfaces of the roller members 60 protrude about 0.50" beyond the lateral surfaces of the vertical posts 30.

Figure 2:
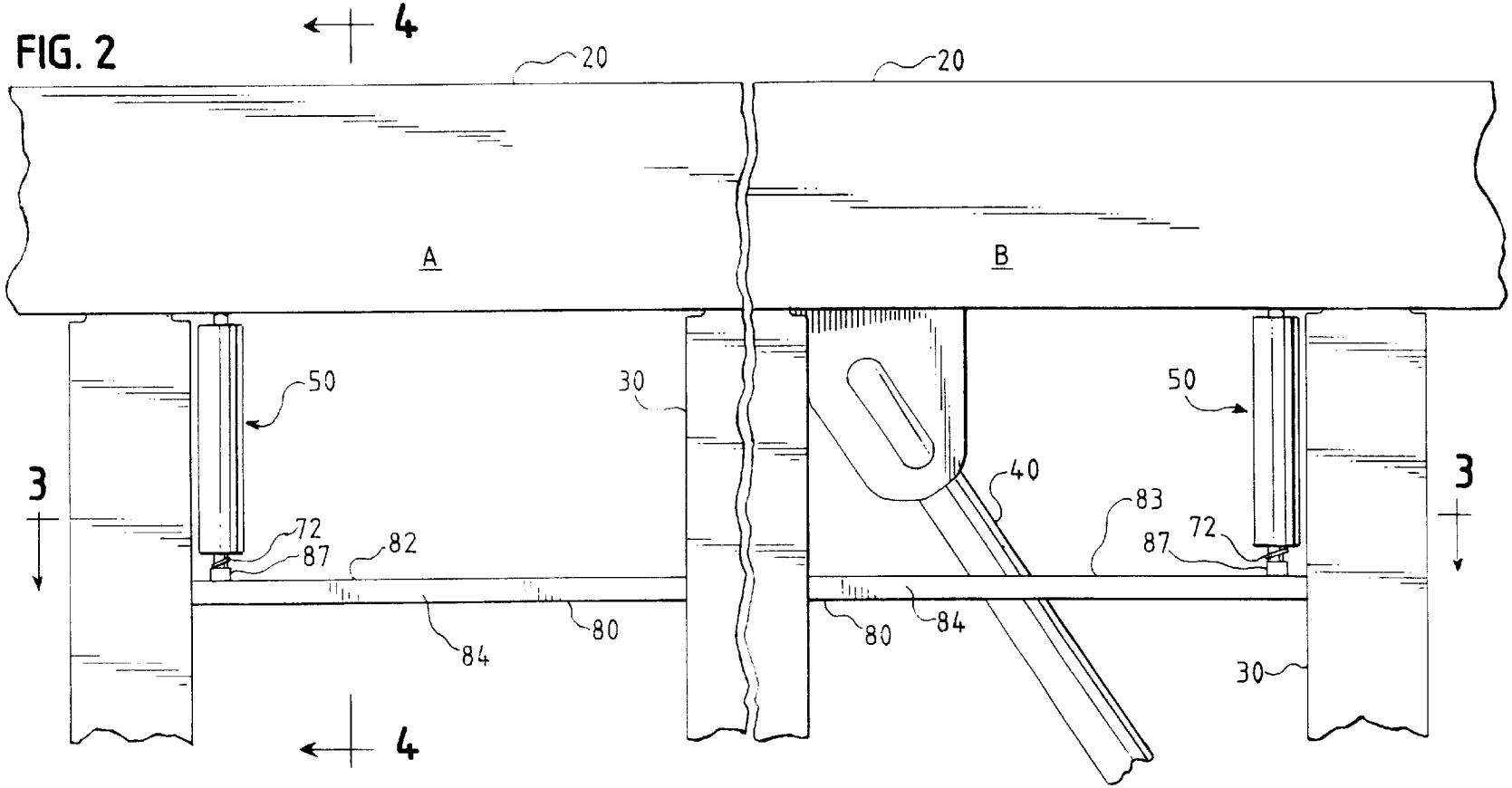
FIG. 2 is a detail side elevation view of portions A and B of the center beam structure of the railway car of FIG. 1.

In an embodiment of the invention, the upper brackets 90 comprise horizontal plates attached to the vertical posts 30 and the top chord 20. The upper brackets 90 have apertures 92 formed therein for receiving the upper ends of the shafts 70, as illustrated in FIGS. 4 and 5. The bottom brackets 80 preferably comprise either a one-piece bracket member 82 comprising a channel member, or a pair of L-shaped bracket members 83, i.e., angle members, that extend between adjacent posts 30, as illustrated in FIGS. 2 and 3. The one-piece and L-shaped brackets 82 and 83 both have planar, horizontal surfaces 89 having flanges 84 depending downward from the longitudinal edges thereof to provide strength to the brackets 82 or 83. The lower brackets 80 have upstanding, cylindrical tubes 87 attached to their planar surfaces 89 for receiving the bottoms of the shafts 70, as illustrated in FIGS. 2 and 4. In an embodiment of the invention, the tubes 87 extend between 1" and 1.5", preferably about 1.25", above the planar lower bracket surfaces 89 and have diameters selected to rotatably receive the lower ends of the shafts 70.

The one-piece bracket member 82 is used to extend between adjacent vertical posts 30 without diagonal brace members 40 near the upper ends thereof, as illustrated in FIGS. 2 and 3. The L-shaped bracket members 83 extend between adjacent vertical posts 30 having diagonal brace members 40 near the upper ends thereof and have a cut-out region 86 to accommodate the diagonal brace members 40. By making the lower bracket members 80 proximate the diagonal brace members 40 from two pieces, the cutouts 86 may be easier to manufacture, and assembly may be simplified, compared to making a cutout through a one-piece bracket member and inserting the brace member 40 therethrough. However, a one-piece member with a cutout may function equally well, although using a two-piece lower bracket member can simplify retrofitting of existing railway cars having diagonal brace members.

In an embodiment of the invention, the vertical posts 30 have an I-shaped cross-section, as illustrated in FIG. 5, comprising two flanges 32 connected by a web 34. The top chord 20 may have an inverted U-shape cross-section, as illustrated in FIG. 4, comprising a pair of flanges 22 depending from a central member 24. According to this embodiment of the invention, each upper bracket member 90 may be recessed between the flanges 32 of the vertical post 30 and attached, such as by welding, to opposing top cord flanges 22. The lower bracket mounting plates 81 may be recessed between opposing flanges 32 of the vertical post 30 and attached therebetween, such as by welding. The flanges 84 of the lower bracket 80 may be partially removed to accommodate engagement with the bottom mounting plates 81, as illustrated in FIGS. 2 and 3.

In the embodiment illustrated in FIGS. 2–5, the upper brackets 90 are preferably sized to fit between the flanges 22 of the top cord, and may be approximately 4.751" in width. The length of the upper brackets 90 is selected to at least provide for sufficient material around the apertures 92, and may be, for example, about 9.375". The upper brackets 90 are positioned so that the tops of the rollers 50 are below the top cord to reduce interference therebetween, and may be disposed about 17.375" below the top of the top chord 20.

The lower brackets 80 are sized to extend between adjacent posts 30, and may be about 47.25" in length. The lower brackets 80 are positioned a distance below the upper bracket 90 selected to permit the roller shaft 70 to be disposed therebetween. The relative positioning of the upper and lower brackets 90 and 80 may also be selected to allow for the installation of the roller 50 after the brackets 90 and 80 have been mounted to the railway car 1. For example, if the roller shaft 70 is 22" long, then the lower bracket 80 may be positioned about 38.75" below the top of the top chord 20.

When the upper end of the shaft 70 is mounted in the upper bracket aperture 92 and the lower end of the shaft 70 is mounted in the tube 87 of the lower bracket 80, the longitudinal axis of the shaft 70 is preferably positioned close to the vertical posts 30 to minimize torsion of the post 30 when lading 8 is resting against a roller member 60 disposed on the shaft 70. The positioning of the shaft 72 relative to the post 30 can be limited by the diameter of the roller member 60, and may be about 7" from the center of the vertical post 30 for a roller member 60 having a diameter of about 3.5".

Figure 8:
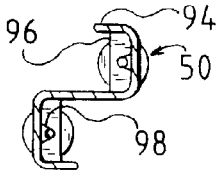
FIG. 8 is a sectional view of a pair of rollers mounted to a Z-shaped post.

The rollers 50 may also be used with other types of vertical posts, such as S-shaped or Z-shaped posts 94, as illustrated in FIG. 8. The rollers 50 may be mounted between mounting plates 96 having apertures 98 for receiving the roller shafts 70. The rollers 50 may be positioned so as to partially protrude through cutouts in the posts 94 and contact lading 8.

In the embodiment of the invention illustrated in FIGS. 1–5, the upper and lower decks 17 and 18 on each side of the center beam structure 10 are canted inwardly toward the structure 10. The vertical posts 30 are tapered, narrowing in width from their bottoms to their tops as illustrated in FIG. 4, such that the upper and lower decks 17 and 18 are substantially normal to the flanges 32 thereof. Such an inclination may cause the lading 8 to tilt inwardly toward the center beam structure 10 and the uppermost bundles of lading 8 can rest against the rollers 50. Although the canted decks 17 and 18 and tapered vertical posts 30 are illustrated in the figures, the invention is not limited to such a configuration. For example, a railway car having upper and lower decks oriented in a generally horizontal plane with vertical posts having generally parallel, vertically oriented flanges may suitably be adapted for reducing chafing.

The lading 8 may comprise bundles of lumber, particle board, or other wood products wrapped in plastic sheeting to provide protection from the elements and dirt. The lading 8 is not limited to bundles of lumber or even lumber; other types of lading 8 are also contemplated by the present invention.

The bundles may be stacked in various orientations on the support surface of the center beam railway car 1 according to the size and type of bundles. For example, multiple bundles may be stacked on the decks 17 and 18 of the railway car 1 up to or beyond the height of the top chord 20 of the center beam structure 10.

From the foregoing, it will be appreciated that the invention provides a center beam railway car adapted for reducing chafing between lading and a center beam structure by providing a roller positioned between the lading and the center beam structure. The invention is not limited to the embodiments described hereinabove or to any particular embodiments. Various modifications to the aforementioned embodiments may result in substantially the same invention.

The invention is defined more particularly by the following claims:

1. A center beam railway car capable of transporting lading in commercial rail service, the railway car having a support surface for supporting the lading, a pair of bulkheads proximate opposite ends of the support surface, and a longitudinally extending center beam structure extending between the bulkheads having outwardly facing lateral surfaces, and at least one roller engaging the lading to reduce chafing contact between the lateral surfaces and the lading.

2. A railway car according to claim 1, wherein the center beam structure comprises a plurality of posts extending vertically upward relative to the support surface, the posts having laterally facing outward surfaces, and a longitudinally extending top chord connecting the posts.

3. A railway car according to claim 2, wherein the roller extends substantially parallel to the vertical posts.

4. A railway car according to claim 2, wherein the roller is disposed proximate the top of one of the vertical posts and below the top chord.

5. A railway car according to claim 1, wherein the roller is vertically translatable with respect to the center beam structure to accommodate vertical shifting of the lading.

6. A railway car according to claim 1, wherein the roller is rotatable relative to the center beam structure to accommodate shifting of the lading parallel to the center beam structure.

7. A railway car according to claim 2, wherein the roller comprises a roller member rotatable about a shaft.

8. A railway car according to claim 7, wherein the lower end of the shaft is rotatably mounted to a bracket extending between adjacent vertical posts.

9. A railway car according to claim 8, wherein the lower end of the shaft is rotatably received within an upstanding tube attached to the bracket.

10. A railway car according to claim 8, wherein a spring member is provided around the lower end of the shaft to bias the roller member from the bracket.

11. A railway car according to claim 7, wherein the upper end of the shaft is rotatably mounted to a plate attached to the center beam structure.

12. A center beam railway car capable of transporting lading in commercial rail service, the railway car having a support surface for supporting the lading, a pair of bulkheads proximate opposite ends of the support surface, and a longitudinally extending center beam structure extending between the bulkheads having outwardly facing lateral surfaces, and at least one friction reducing member positioned between the lading and the center beam structure effective to reduce chafing contact between the lateral surfaces and the lading due to both vertical and horizontal relative movement between the lading and the center beam structure.

13. A center beam railway car according to claim 12, wherein the friction reducing member comprises a roller member rotatable about a shaft to accommodate horizontal relative movement between the lading and the center beam structure.

14. A center beam railway car according to claim 12, wherein the friction reducing member comprises a roller member vertically translatable relative to the center beam structure to accommodate vertical relative movement between the lading and the center beam structure.

15. A method of reducing chafing of lading on a center beam railway car, the center beam railway car having a longitudinally extending center beam with a plurality of vertical posts and a top chord connecting the vertical posts, the method comprising:

mounting at least one roller relative to the center beam; and resting lading against the roller such that at least a portion of the lading contacts the roller, the roller being effective to reduce chafing between the vertical posts and the lading.

16. A method of reducing chafing according to claim 15, including orienting a longitudinal axis of the roller substantially parallel to the vertical posts.

17. A method of reducing chafing according to claim 15, including adapting the roller for rotational movement relative to the vertical posts to accommodate longitudinal shifting of the lading.

18. A method of reducing chafing according to claim 15, including adapting the roller to translate vertically with respect to the center beam to accommodate vertical shifting of the lading.

19. A method of reducing chafing according to claim 18, including biasing the roller with a spring member to allow the roller to translate along its longitudinal axis to accommodate vertical shifting of the lading.

20. A method of reducing chafing according to claim 15, including mounting the roller proximate the top of the vertical post and below the top chord.

21. A center beam railway car for transporting lading, the railway car having a generally planar support surface, a pair of bulkheads proximate opposite ends of the support surface, and a longitudinally extending center beam structure extending between the bulkheads having outwardly facing lateral surfaces, and means positioned between the lading and the centerbeam structure for reducing chafing between the lateral surfaces of the center beam structure and the lading.

22. A center beam railway car capable of transporting lading in commercial rail service, the railway car comprising:

a longitudinally extending center beam structure having a plurality of vertically extending posts with outwardly facing surfaces and a longitudinally extending top chord connecting the posts; and at least one roller extending substantially parallel to the outwardly facing surfaces of the vertical posts effective to reduce chafing contact between the outwardly facing surfaces and the lading.

23. A railway car according to claim 22, wherein the roller is disposed proximate the top of one of the vertical posts and below the top chord.

24. A railway car according to claim 22, wherein the roller is vertically translatable with respect to the center beam structure to accommodate vertical shifting of the lading.

* * * * *